United States Patent [19]

Shames et al.

[11] 4,204,646

[45] May 27, 1980

[54] HAND-HELD PULSATING SHOWER

[76] Inventors: Sidney J. Shames, 57 Holly Pl., Briarcliff Manor, N.Y. 10510; Harold Shames, 5 Agnes Cir., Ardsley, N.Y. 10502

[21] Appl. No.: 5,161

[22] Filed: Jan. 22, 1979

[51] Int. Cl.[2] ..... B05B 1/08

[52] U.S. Cl. ..... 239/443; 239/381; 239/449

[58] Field of Search ..... 239/101, 102, 381, 383, 239/443, 449

[56] References Cited

U.S. PATENT DOCUMENTS

| | | | |
|---|---|---|---|
| 3,473,736 | 10/1969 | Heitzman | 239/383 X |
| 3,801,019 | 4/1974 | Trenary | 239/102 X |
| 3,963,179 | 6/1976 | Tomaro | 239/102 X |
| 4,081,135 | 3/1978 | Tomaro | 239/447 X |

*Primary Examiner*—John J. Love
*Attorney, Agent, or Firm*—Norman Lettvin

[57] ABSTRACT

A shower head that employs a rotor for effecting a pulsed jet-discharge is embodied in a construction by means of which the user may selectively secure either a pulsed jet-discharge or continuous spray discharge from the shower head. The rotor is housed between upstream and downstream housing parts that are axially movable between pulsed discharge and spray discharge positions, by relative rotation of said upstream and downstream housing parts through a screw-threaded connection so that the user's selection between pulsed jet-discharge and continuous spray is achieved by a simple rotary motion of the downstream housing part. A selectively releasable stop member limits rotation in one direction to insure proper axial spacing of said upstream and downstream housing parts when pulsed jet-discharge is selected. When the upstream and downstream housing parts are axially spaced closest together, the rotor is driven, and the assembly functions to provide pulsed jet-discharge from only one set of apertures, and when said parts are spaced further apart axially, then other apertures in the downstream housing part are exposed so that a continuous spray of discharge is achieved through all apertures.

17 Claims, 9 Drawing Figures

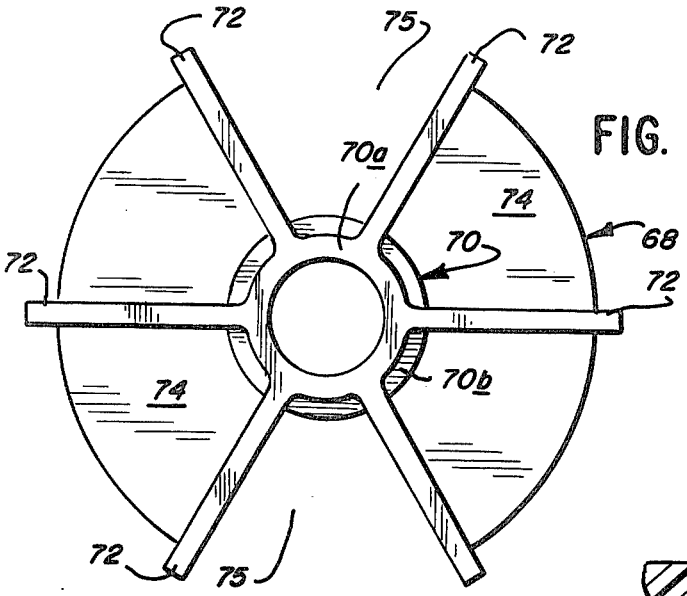
FIG. 3
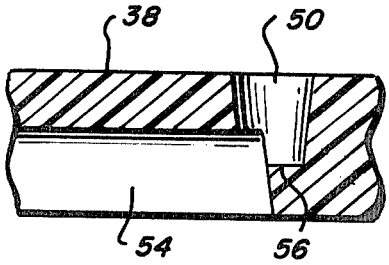
FIG. 6
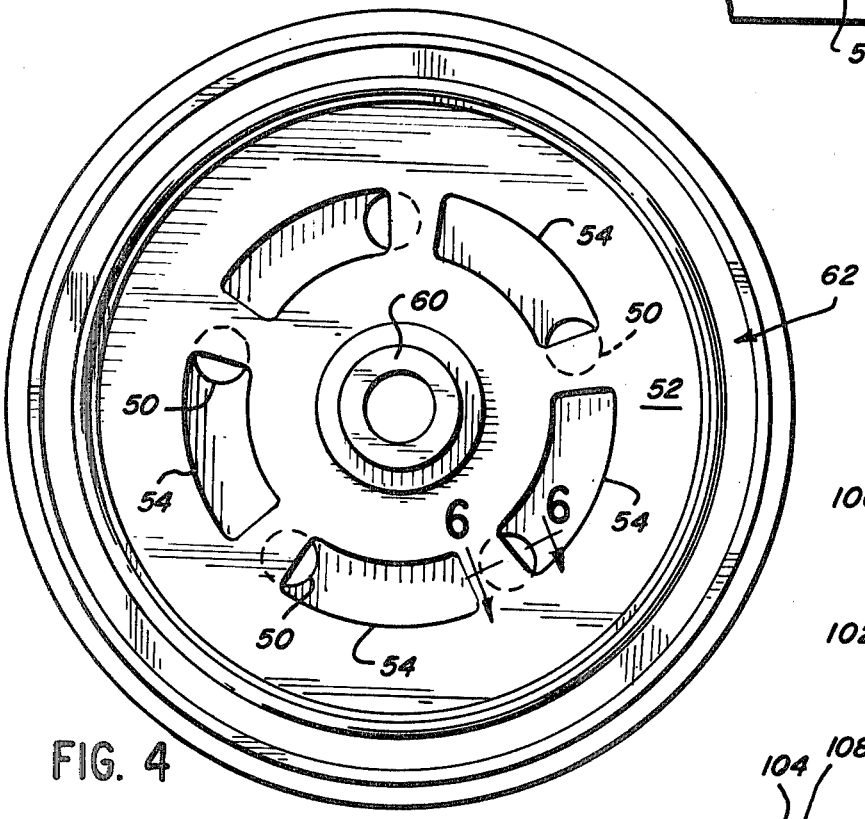
FIG. 4
FIG. 8
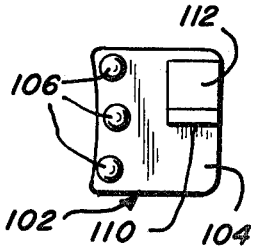
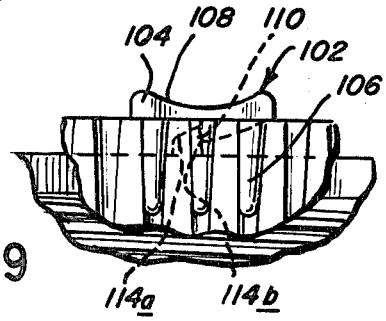
FIG. 9

HAND-HELD PULSATING SHOWER

FIELD OF THE INVENTION

This invention relates to a shower head construction that may selectively provide either a pulsating jet-discharge or continuous spray therefrom, and wherein the principal parts of the construction are formed of plastic for economy of manufacture.

BACKGROUND OF THE INVENTION

It has been known to provide a pulsating jet-discharge of water in shower heads by inclusion of a rotor between the source of water and the discharge end of the shower head as in U.S. Pat. No. 2,878,066. It has been also known to provide a hand-held, trigger-like valve-controlled, bath appliance for providing a shower-like spray therefrom, as disclosed in U.S. Pat. No. 3,637,143.

Others have heretofore proposed providing a shower head that selectively delivers a pulsating jet-discharge or a continuous spray issuing therefrom. Such prior constructions have employed relatively complex and expensive constructions, and some such constructions have been unable to provide an adequately large number of discharge jets when the device is to be used to deliver a continuous spray.

It is, therefore, one object of this invention to provide a shower head that may be caused to discharge therefrom, selectively, either a pulsating jet-discharge, or a continuous spray from an adequately large number of spray discharge apertures.

Another object of this invention is to provide a shower head with portions that may easily and efficiently be selectively manipulated between alternate axial spaced positions at which the shower head delivers either a pulsating jet-discharge or a continuous spray therefrom.

And a further object of this invention is to provide a shower head having selective character by means of which to provide either pulsating or steady state spray flow therefrom and which is characterized by inexpensiveness of construction and effectiveness of operation.

Further objects and advantages will become known, or will be apparent to one skilled in the art, by reference to the following specifications and drawings.

BRIEF SUMMARY OF THE INVENTION

A shower head, using a rotor for effecting a pulsating jet-discharge, and from which to selectively discharge either a continuous spray or a pulsating jet, is inexpensively constructed of plastic parts.

The rotor is enclosed between an upstream plastic housing means that includes a transverse, upstream, apertured wall, and a downstream plastic cup-shaped member that connect together through screw-threads to provide means for selectively controlling the axial spacing between said upstream apertured wall and the downstream transverse wall of the cup-shaped member. The downstream transverse wall is provided with two concentric sets of jet-discharging apertures therethrough.

The upstream apertured wall is constructed to provide laterally directed jets therefrom, for driving a rotor that is posiioned between the upstream and downstream transverse walls when the said transverse walls are axially spaced relatively close together. The upstream apertured wall is inexpensively created by molding two sets of recesses in the top and bottom surfaces of the wall, the recesses of the two sets generally being circumferentially offset but joined at a common junction point, so that the sides of a pair of recesses from each of the two sets operate effectively to provide a flow-turning means.

The downstream transverse wall provides an adequately large number of spray discharge apertures in the outer set of apertures. Relative rotary motion between the downstream member and upstream means operates alternatively to put the rotor in operative condition while simultaneously shutting off flow to the outer set of apertures, and to direct pulsating jet-discharge through only the inner set of apertures, or to put the rotor in an inoperative condition, while simultaneously causing spray flow through both sets of discharge apertures.

Conveniently the improved shower head is incorporated into a hand-held housing of the type generally disclosed in U.S. Pat. No. 3,637,143.

BRIEF DESCRIPTION OF THE DRAWINGS

FIG. 3 is an enlarged top plan view of the rotor that is shown in partial vertical cross-section in FIGS. 1 and 2;

FIG. 4 is an enlarged bottom plan view of the upstream housing means shown in vertical cross-section in FIGS. 1 and 2;

FIG. 6 is a fragmentary cross-sectional view taken substantially on line 6—6 of FIG. 4;

FIG. 8 is an enlarged bottom plan view of the top member shown in its operative position in FIG. 2; and FIG. 9 is an enlarged fragmentary view taken substantially on line 9—9 of FIG. 2, showing the stop member of FIG. 8 cooperating with the rib and groove features of the upstream housing means that are also seen in plan view in FIG. 5.

Figure 1:
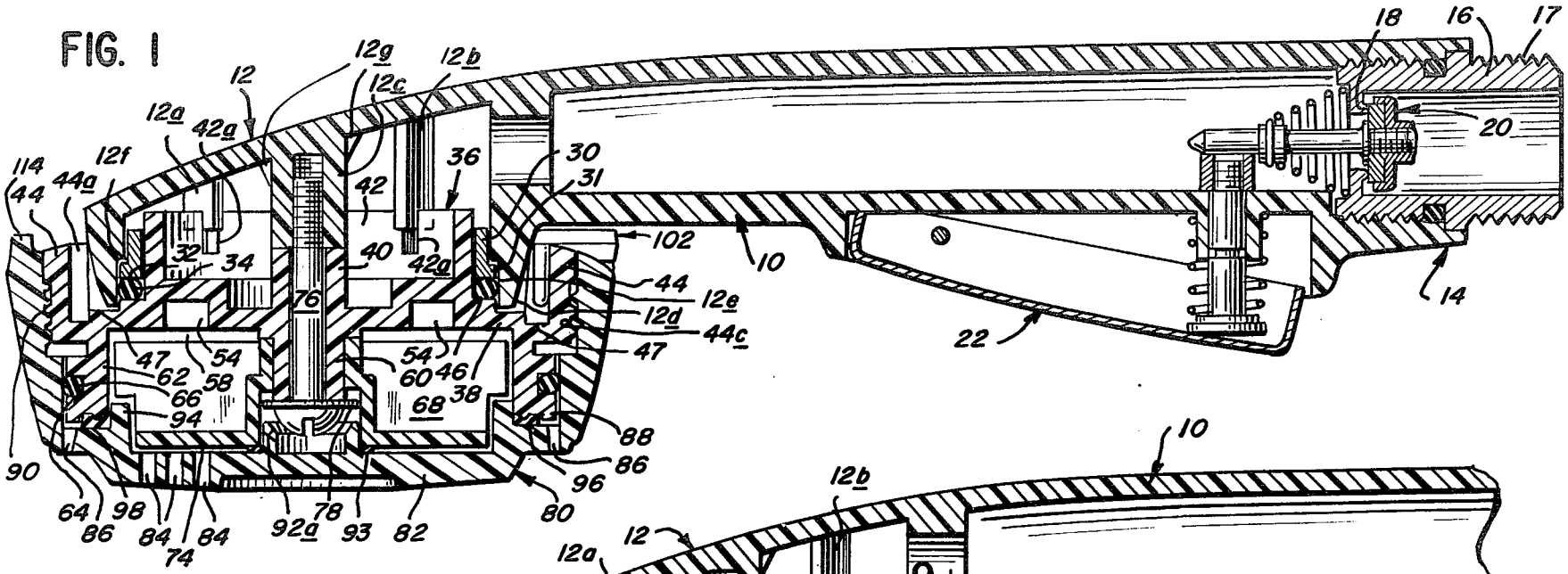
FIG. 1 is a vertical axial cross-sectional view through a hand-held housing, whose discharge end includes the shower head of this invention, and showing the parts of the shower head in position for discharging therefrom a pulsating jet.

The shower head portions that are hereinafter described can be used either as part of a hand-held shower appliance or as part of a wall mounted shower appliance. More specifically, and in a preferred form as shown in the drawings, the shower head is shown as the downstream head portion of a handheld appliance whose body includes an elongated tubular member 10 molded of plastic to provide a downstream, cup-shaped, head end 12 and an upstream tubular connector end 14. The connector end 14 is provided with a fitting 16 that defines therein an upstream facing valve seat 18 against which is seated a spring-biased, rocker type valve 20 that is actuatable to an open, flow-permitting, position through a trigger-like squeeze controller 22 that is pivotally mounted on the appliance body. Said structure corresponds with the same or equivalent structure disclosed in U.S. Pat. No. 3,637,143.

One modification over the structure of said Patent 3,637,143 is provided in upstream fitting 16. Since it is desirable to provide for a larger flow volume to the shower head means of FIGS. 1 and 2 that provides for pulsed jet-discharge, the upstream fitting is provided with a male threaded nipple 17, so that the feed tube or hose that connects thereto may be provided with greater inner diameter, so as to avoid reducing the inner dimension and flow carrying capacity of the fitting 16.

Another modification over the structure of Patent 3,637,143 is to provide in the downstream hollow head end 12, as part of the molded structure, a set of four (4) radially extending reinforcing and spacing ribs, two of which are shown at 12*a* and 12*b*, that are equally spaced circumferentially from and concentrically of a center stem 12*c* that is provided with axially-extending thread means therein. The junction of stem 12*c* with body 10 is strengthened and reinforced by ribs 12*g*. The downstream facing terminus 12*d* of the terminus of body 10 at head end 12 is provided with an inner cylindrical sleeve wall 12*e* that terminates at an upstream, inner, annular shoulder 12*f*. These elements on the head end 12 are specifically constructed and arranged to receive and engage portions of the shower head parts that will now be described.

A tubular annulus 30, shaped to provide a downstream abutment flange 31, is formed of plastic such as Delrin, and is slide fit into sleeve wall 12*e*, thereby providing an axially enlarged annular shoulder 32 against which a sealing O-ring 34 abuts. The upstream edge of annulus 30 engages the lower edges of ribs 12*a* and 12*b*. An upstream housing means 36, in the form of a molded plastic annulus with multiple features provided therein, is fit into head end 12. The upstream housing means 36 is shaped to provide an upstream annular disc 38 that extends across the opening of head end 12 and is provided with three annular concentric sleeves, or walls, extending upstream of said disc.

The inner sleeve 40 of the three concentric sleeves is shaped and arranged to abut the downstream terminus of center stem 12*c* when the housing means 36 is properly positioned in head end 12. The middle concentric sleeve 42 slidably engages the inner wall of tubular annulus 30. Sleeve 42 extends upstream of the upstream extent of inner sleeve 40 and annulus 30. The upstream edge portion of sleeve 42 is provided with radial slots 42*a* positioned to slidably receive thereinto lower portions of ribs 12*a* and 12*b*, but with lower edges of slots 42*a* spaced from the downstream edges of ribs 12*a* and 12*b*.

Figure 5:
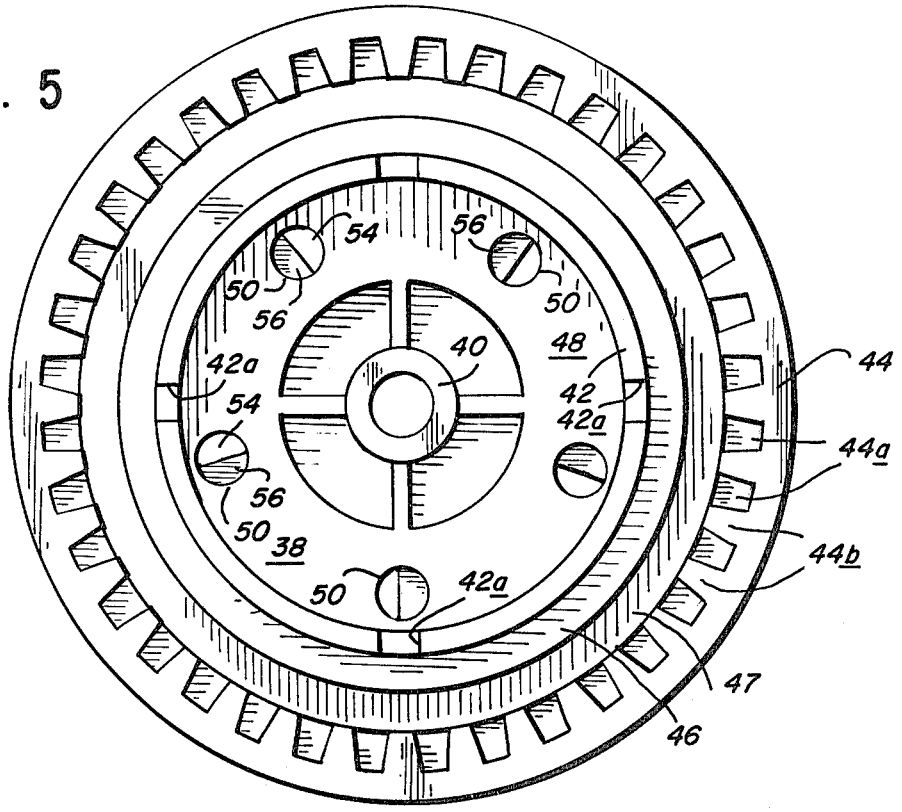
FIG. 5 is a top plan view of the upstream housing means shown in FIG. 4.

The upstream outer sleeve 44 of upstream housing means 36 is located concentrically and spaced radially outwardly of the downstream annulus of head end 12. The inner surface of sleeve 44 is provided with axially extending alternate grooves 44*a* and ribs 44*b* as best seen in FIG. 5. The outer surface of the outer sleeve 44 is provided with male attachment threads 44*c* molded therein.

Figure 2:
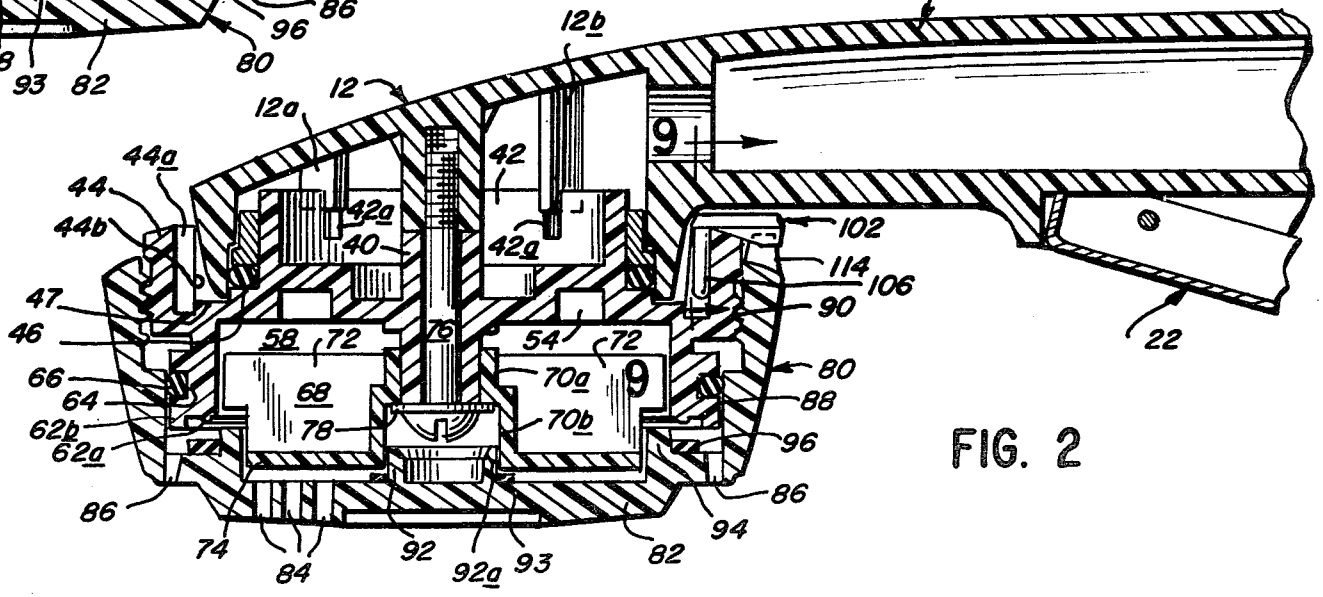
FIG. 2 is a fragmentary view similar to FIG. 1 but showing the parts of the shower head in position for discharging therefrom a continuous spray.

The upstream annular disc 38 is shaped so as to provide an annular, upstream facing, abutment surface 46 that surrounds middle sleeve 42 and is positioned to engage O-ring seal 34. The location of abutment surface 46 is such that it enters into and upstream of the downstream terminus flange 12*d* of head end 12 of body 10. Another annular surface 47 is provided surrounding annular abutment surface 46 but spaced downstream thereof so as to confront the downstream terminus of flange 12*d* and to be spaced closely therefrom as seen in FIGS. 1 and 2. The annular disc 38 provides, radially inwardly of sleeve 42, an annular upstream surface 48, best illustrated in FIG. 5 as being provided with five (5) circumferentially, equally spaced bores, 50 that extend into the thickness of the material of disc 38 but not through disc 38, as can best be seen by the enlarged detail illustrated in FIG. 6.

The underside of disc 38 related to bores 50 is best illustrated in FIG. 4 and includes a generally planar surface 52 that has formed therein five (5) circumferentially, equally spaced, channel-shaped recesses 54, that extend into the thickness of material of disc 38 but not through the entire thickness of disc 38. One end of each elongated channel 54 is positioned to overlap and intersect with the bore 50, as can be seen in FIGS. 4 and 6. This arrangement provides a bottom wall 56 at the lower end of bore 50 so that water entering through each upstream bore 50 is turned laterally and discharges into an associated downstream opening channel 54. The length of channel 54 is such as to direct any water discharging into the channel 54 in a circumferential and downwardly inclined direction for purposes of driving a rotor in a rotor chamber 58 that is located below surface 52.

Projecting from the underside of housing means 36 are two annular, concentric, downstream extending sleeves 60 and 62. The inner downstream sleeve 60 is substantially an extension of upstream inner sleeve 40. The outer sleeve 62 is located radially inwardly of the outer, upstream-extending, sleeve 44. The downstream extending outer sleeve 62 is formed with a circumferential outwardly facing groove 64 that receives thereinto an O-ring seal 66. The downstream edge of sleeve 62 is provided with a circumferential seal rib 62*a* adjacent radial inner surface of sleeve 62 and a concentric outer circumferential gasket retainer flange 62*b*, both for cooperation with gasket 96 as seen in FIG. 1.

The inner and outer downstream:extending, concentric cylindrical sleeves 60 and 62 partially define the annular rotor chamber 58. The channels or recesses 54 communicate with the rotor chamber 58 so that fluid directed circumferentially and downstream of the channels 54 are directed into the rotor chamber 58.

Within the rotor chamber there is positioned a rotor 68 that is seen in a vertical cross-section in FIGS. 1 and 2, and top plan view in FIG. 3. The rotor 68 is an integral part molded of plastic, such as Delrin, and includes an axially elongated, stepped, sleeve-type hub 70 from which projects six (6) radially extending, and equally circumferentially spaced vanes 72, and two radial web portions 74 that are located at the downstream end of rotor 68 and are integral with the downstream edges of vanes 72.

The inner bore of the upstream portion 70*a* of sleeve-type hub 70 is of a size to provide for sliding and rotation about downstream sleeve 60 that serves as a journal for the rotor 68. The sleeve-type hub 70 has a stepped, radially enlarged, downstream portion 70*b* that rigidifies the adjacent vanes 72 and webs 74. The arcuate extent of each web 74 is such as to bridge the space included between three vanes, as seen in FIG. 3, but leaving a pair of straight through flow channels 75 through the rotor 68. The webs 74 and flow through channels 75 of the rotor 68 are arranged symmetrically, as seen in FIG. 3.

The radially enlarged downstream hub portion 70*b* of rotor 68 is of a size to provide clearance of fastening means which holds upstream housing means 36 assembled on the head end 12 of body 10. The fastening means includes an elongated headed screw bolt 76 which is screwed into the threaded means in center stem 12*c*, the shank of bolt 76 extending through sleeves 40 and 60 and the head of bolt 76 engaging a washer 78 that engages the downstream edge of sleeve The downstream end of rotor chamber 58 is defined by a cup-shaped downstream housing member, generally 80, which is a part moulded of plastic and having a downstream transverse wall 82 through which liquid is discharged. The transverse wall 82 is provided with two concentric sets of jet-discharging apertures, the inner set being apertures 84, arranged in three equally circumferentially spaced radial lines each having three apertures, through which a pulsed jet-discharge is to be effected, and the outer set of apertures being 86. When the parts are in the position of FIG. 1, the discharge is only through apertures 84 and is a pulsed jet-discharge. When the parts are in the position of FIG. 2, the discharge is through both sets of apertures 84 and 86 and is in the form of a continuous spray.

The portion of member 80 upstream of transverse wall is the side wall of the cup shape having an inner surface that provides a downstream inner cylindrical sealing wall 88 arranged for sliding sealing engagement with O-ring 66 and an outer cylindrical surface concentric with walls 88 and formed with female screw threads 90 adapted for screw connection to the male screw threads 44*c* provided on upstream housing means 36.

The transverse wall 82 of cup-shaped member 80 is provided with a central upstream extending sleeve 92 that serves as a centering stud for a plastic washer 93 that surrounds sleeve 92 and which serves as a bearing for engaging the downstream wall of the hub portion 70*b* of the rotor 70 when the parts are in the position shown in FIG. 1. The upstream edge of sleeve 92 is provided with an inner taper 92*a* to provide for clearance with the head of screw bolt 76.

An outer retainer sleeve 94 projects the upstream of transverse wall 82 to be located in closely spaced concentric relation with the inner surface of sleeve 62 on upstream housing means 36 when in the position of FIG. 1. Surrounding the outer sleeve 94 is an annular rubber gaske 96 that is supported on annular wall 98 located in a plane spaced upstream of the surface from which sleeve 92 projects. In the portion of the annular wall 98 that is located concentrically outwardly of gasket 96, the series of apertures 86 are located adjacent the inner cylindrical sealing wall 88 on the side wall of the cup shape. The outer surface of cup-shaped member 80 is provided with three axially extending ribs 100, that are radially aligned with the radial lines of apertures 84 as can be seen in the plan view of FIG. 7. The ribs 100 provide for ease in grasping to effect rotary motion of member 80 relative to upstream housing means 36.

FIG. 1 shows the position of the parts when the cup-shaped member 80 is screwed onto its upstream position. At that point, the washer 93 has engaged the underside of the rotor 68 maintaining the rotor spaced upstream of the downstream transverse wall 82, and at that position the upstream hub portion 70*a* of the rotor is spaced above the washer 78. In the position illustrated in FIG. 1, the hub portion 70*a* of rotor 68 is engaging only the downstream sleeve 60 that serves as a low-friction journal. When water is directed through water passageways 50 and 54 circumferentially and downwardly into rotor chamber 58, the water strikes the vanes 52 of the rotor causing same to rotate rapidly with a minimum of friction. Since the webs 74 and through channels 75 of the rotor 68 alternately pass above each set of inner apertures 84, there is produced a pulsating jet-discharge through the apertures 84 that will be projected from the shower head.

When the cup member 80 is in the upstream position of FIG. 1, the lower edge of the outer sleeve 62 is compressed against the rubber gasket 96, thereby sealing off any water flow to the outer set of apertures 86, and only a pulsed discharge will be effected from the first set of apertures 84.

When the cup-shaped member has been moved axially downstream to the position shown in FIG. 2, the lower end of the sleeve-type hub 70*a* of the rotor will engage the washer 78 while the downstream transverse wall 82 moves further downstream opening up a passageway between the rubber seal gasket 96 and the lower edge of the sleeve 62 of the upstream housing means, so that the flowing water then communicates both to outer apertures 86 and inner apertures 84 to effect a jet discharge through both sets of apertures 86 and 84.

Thus, it will be seen that when the cup-shaped member is moved axially upwardly so that the downstream transverse wall 82 is closest to the upstream transverse wall 38, then only a pulsating jet discharge is effected from the shower head, while when the cup-shaped member is moved axially to a downstream position as seen in FIG. 2, with the downstream transverse wall 82 spaced a greater distance from upstream transverse wall 38, then there is effected continuous spray discharge from the shower head.

Figure 7:
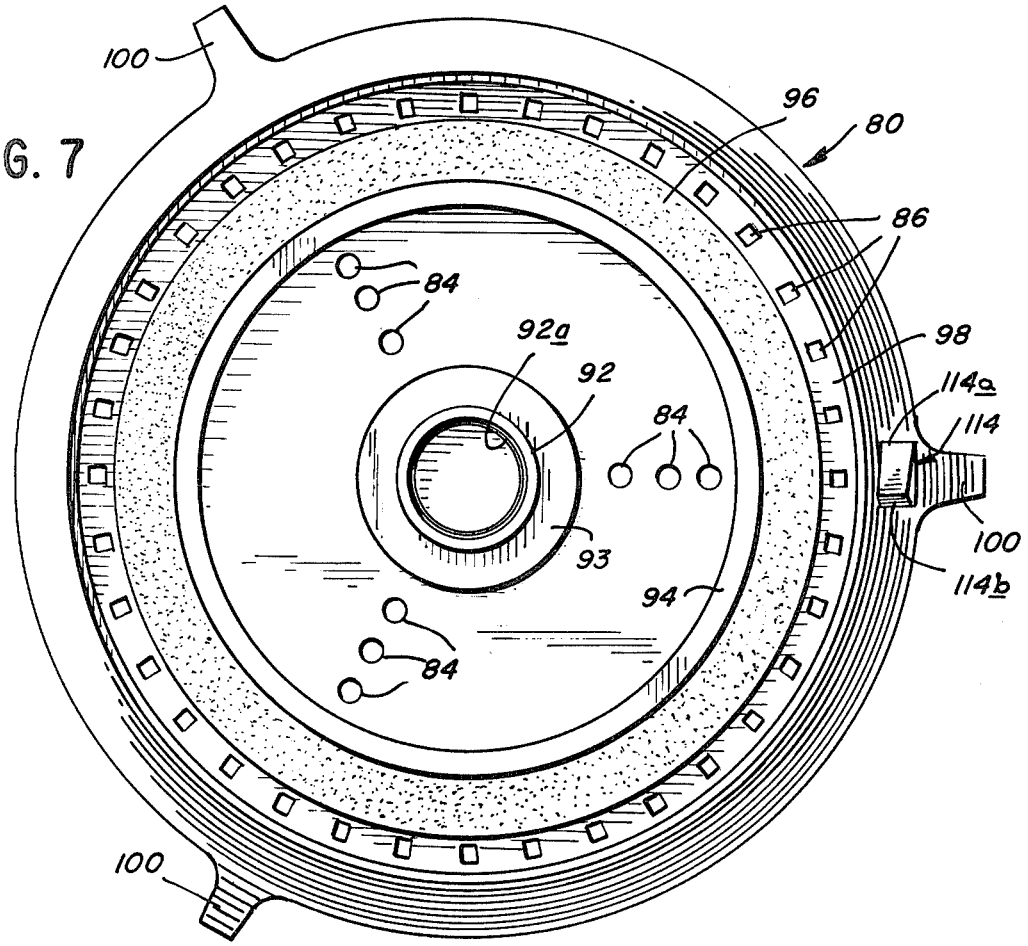
FIG. 7 is an enlarged top plane view looking into the cup-shaped, downstream housing member that is shown in FIG. 2 assembled on the upstream housing means.

In addition to the foregoing, a stop means is provided, details of which are seen in FIGS. 7–9, and cooperation of which is illustrated in FIG. 1. The stop means includes stop member, generally 102, that is a molded plastic part having an upper plate portion 104 and three (3) elongated, depending, tapering retention tines 106, arranged arcuately and radially inwardly, as best seen in FIG. 8. The tines 106 are spaced and dimensioned to fit into three (3) grooves 44*a* defined in the outer sleeve 44 of the upstream housing means 36, as best seen in FIG. 9 in elevation, and in FIGS. 1 and 2 in the section view. The taper of tines 106 permits rocking of stop member 102 when in position shown in FIG. 9.

The stop member plate 104 is provided with an upper concave surface 108 that lies in general concentric relation with the arcuate outer surface of member 10 that has a general circular exterior configuration. The underside of plate 104 is provided with a radial outward abutment that has a counterclockwise facing shoulder 110 at the end of an inclined ramp or cam 112. The ramp 112 and abutment shoulder 110 are located outwardly of upstream outer sleeve 44.

The cup-shaped member 80 is provided at the upper end thereof with an upstanding shoulder 114 that has an inclined camming edge 114*a* and a counter clockwise facing abutment shoulder 114*b*. It will be understood that as the cup-shaped member 80 is rotated clockwise to move the transverse wall 82 towards its upstream position shown in FIG. 1, the shoulder 114 will cam past the stop 112 and engage the shoulder 110 as can be seen in broken lines in FIG. 9. At that point, the desired compression of gasket 96 has been effected to provide for proper sealing, and the parts will then be held in the stop position illustrated in FIG. 1 at which pulsating spray flow will issue from the shower head. When it is desired to release the shower head from the pulsating jet-discharge position, the plate 104 may be tilted upwardly to permit clearance of the abutment 110 with the abutment face 114*b*, and by screwing the cup-shaped member 80 counter-clockwise the parts can be selectively moved to the spray position shown in FIG. 2.

While particular embodiments of this invention have been shown and described, it will be obvious to those skilled in the art that various changes and modifications may be made therein without departing from the spirit and scope of the invention and, therefore, it is intended in the appended claims to cover all such changes and modifications which fall within the true spirit and scope of the invention.

What is claimed is:

1. In a shower head that includes therein a rotor which aids in providing a pulsed discharge of water jets, the improvement comprising, in combination:

upstream housing means including an upstream transverse wall and downstream extending, axially elongated, inner and outer concentric cylindrical walls that partially define an annular rotor chamber for a rotor, jet forming and directing means in the upstream transverse wall directing jets downstream thereof into the rotor chamber at a rotor driving attitude;

a rotor in said rotor chamber;

a cup-shaped downstream housing member including a downstream transverse wall with two concentric sets of jet-discharging apertures therethrough; means securing the downstream housing member to the upstream housing means in a manner for selectively moving said downstream transverse wall axially toward or away from said upstream transverse wall respectively between a first position at which pulsed jet-discharge is effected and a second position at which a continuous spray is discharged; and means for selectively discharging either a pulsed jet-discharge through only one of the sets of jet-discharging apertures, or a spray through both sets of jet-discharging apertures.

2. A shower head as in claim 1 wherein the cup-shaped downstream housing member and the upstream housing means have adjacent concentric cylindrical portions, and there being an O-ring seal means between said adjacent concentric cylindrical portions to provide a sliding seal therebetween.

3. A shower head as in claim 1 wherein the outer one of the two concentric sets of jet-discharging apertures is located radially outwardly of the rotor chamber.

4. A shower head as in claim 3 wherein there are axially facing annular portions provided on the upstream housing means and on the downstream transverse wall that are located inwardly of the outer set of jet-discharging apertures, and that provide a watertight seal means therebetween when the transverse wall is in the position at which pulsed jet-discharge is effected, whereby said seal means operate to prevent discharge of water through the other set of jet-discharging apertures.

5. A shower head as in claim 4 wherein the watertight seal means is an annular, resiliently deformable, rubber gasket carried by the downstream transverse wall.

6. A shower head as in claim 4 wherein the watertight seal means is an annular O-ring carried by the downstream transverse wall.

7. A shower head as in claim 1 wherein the rotor is annular, and the upstream housing means provides an axially elongated downstream journal for the annular rotor to rotate upon when the downstream housing member is in said first position that is axially closest to said upstream transverse wall.

8. A shower head as in claim 7 wherein the elongated journal is of such length as to permit the rotor to move axially thereon when the downstream transverse wall is moved axially away from the upstream transverse wall, and stop means operatively associated with the elongated journal for limiting axial movement of the rotor downstream as the downstream transverse wall moves to the position that is distal from the upstream transverse wall.

9. A shower head as in claim 7 including an antifriction washer on the downstream transverse wall, located axially inwardly of the inner set of jet-discharging apertures, for engaging the rotor when the downstream transverse wall is in the position in which it moves the rotor upstream from said stop means.

10. A shower head as in claim 1 wherein the rotor is annular and has a circumferentially continuous axial elongated sleeve-type hub, and a transverse downstream web portion that extends radially outwardly of the hub portion, said web portion being discontinuous to provide alternate rotor portions that alternatively provide for, or prevent, axial liquid flow through the rotor.

11. A shower head as in claim 10 wherein the rotor includes a plurality of equally circumferentially spaced vanes projecting radially from the hub.

12. A shower head as in claim 11 wherein the vanes of the rotor project radially outwardly beyond the radially outward extent of the transverse web portion of the rotor.

13. A shower head as in claim 10 wherein the downstream transverse wall has upstream extending concentric inner and outer cylindrical flanges bounding the region in which the inner set of jet-discharging apertures is located, and positioned to receive between said flanges the rotor's said downstream web portion and adjacent hub portion when the downstream transverse wall is in position axially closest to the upstream transverse wall.

14. A shower head as in claim 1 wherein each of the upstream housing means, the cup-shaped downstream housing member, and the rotor are unitary bodies molded of plastic.

15. A shower head as in claim 1 wherein the jet forming and directing means in the upstream transverse wall includes an upstream opening entry passageway that exends axially downstream only part way into said upstream transverse wall, a lateral opening in said upstream transverse wall communicating with said entry passageway, and an elongated, downstream opening, channel defined in the downstream side of the upstream transverse wall and communicating with said entry passageway through said lateral opening and being of a length to cause a downwardly and laterally inclined jet to be directed downstream of the upstream transverse wall against the rotor in the rotor chamber.

16. A shower head as in claim 15 wherein said elongated, downstream opening, channel is arcuately disposed concentrically with the rotor chamber and rotor therein.

17. A shower head as in claim 1 wherein said means for securing the downstream housing member to the upstream housing means are screw threads on said housing member and housing means which provides for selective relative rotary motion therebetween, a stud on the upper edge of the downstream member extending upstream thereof, and a stop member carried on the upstream housing means and having a shoulder thereon positioned to be engaged by said stud to hold said downstream housing member at a preselected axial position relative to said upstream housing means.

* * * * *